US006786128B1

(12) United States Patent
Gaudet

(10) Patent No.: US 6,786,128 B1
(45) Date of Patent: Sep. 7, 2004

(54) FLUID MOTOR

(76) Inventor: Ronald M. Gaudet, 60 Cranberry La., Cheshire, CT (US) 06410

( * ) Notice: Subject to any disclaimer, the term of this patent is extended or adjusted under 35 U.S.C. 154(b) by 76 days.

(21) Appl. No.: 10/335,805

(22) Filed: Jan. 2, 2003

(51) Int. Cl.[7] ..... F01B 15/00
(52) U.S. Cl. ..... 91/216 B; 417/405; 92/54
(58) Field of Search ..... 92/54; 91/216 B; 417/392, 405, 406

(56) References Cited

U.S. PATENT DOCUMENTS 779,900 A * 1/1905 Bartlett ..... 91/216 B
1,390,744 A 9/1921 Ambrose
1,802,887 A * 4/1931 Feyens ..... 418/54
3,141,446 A 7/1964 Nittka
3,285,189 A 11/1966 Doyer
3,690,791 A 9/1972 Dieter
3,873,245 A * 3/1975 Doshi ..... 418/5
4,563,136 A 1/1986 Gervais et al.
4,637,786 A 1/1987 Matoba et al.

* cited by examiner

*Primary Examiner*—Edward K. Look
*Assistant Examiner*—Michael Leslie
(74) *Attorney, Agent, or Firm*—Bachman & LaPointe, P.C.

(57) ABSTRACT

A fluid motor has a rotor mounted within a housing internal space. A piston positioned within the rotor and may be mounted to an output shaft. The output shaft is driven by applying pressure difference from a fluid both across the rotor within the internal space and across the piston so as to bias the rotor against the housing and produce a camming action to rotate the rotor.

9 Claims, 6 Drawing Sheets

118A
29A
28A
22A
500
502
24A
118B
42A
42B
35A
34
27
25A
35B
26
25B
2
29B
23
22B
21
39
38
28B
24B
20
32
40
41
31
30

2

FLUID MOTOR

BACKGROUND OF THE INVENTION (1) Field of the Invention

This invention relates to rotary fluid devices, and more particularly to fluid motors.

(2) Description of the Related Art

Rotary fluid apparatus are known. These may include internal combustion engines (such as the Wankel rotary engine), fluid motors (including external combustion engines), and pumps. In an illustrative configuration, a rotor is mounted within a chamber and divides the chamber into two or more transient volumes. The rotor is mounted for more than a simple rotation about an axis fixed relative to the housing. During a cycle of the apparatus, the relative size of the transient volumes changes (including the possibility of transient nullity and transient merger) so as to provide the desired functionality.

BRIEF SUMMARY OF THE INVENTION

In one aspect, the invention is directed to an apparatus for extracting work from a fluid passing between a relatively high pressure source and a low pressure destination. The apparatus has a housing having an internal space. A rotor is mounted within the housing internal space. A piston is mounted within the rotor. An output member is mounted for rotation relative to the housing about an axis. The apparatus includes means for driving the output member by applying a pressure difference from said fluid: across the rotor within the internal space; and across the piston so as to bias the rotor against the housing and produce a camming action to rotate the rotor.

The details of one or more embodiments of the invention are set forth in the accompanying drawings and the description below. Other features, objects, and advantages of the invention will be apparent from the description and drawings, and from the claims.

BRIEF DESCRIPTION OF THE DRAWINGS

Like reference numbers and designations in the various drawings indicate like elements.

DETAILED DESCRIPTION

Figure 1:
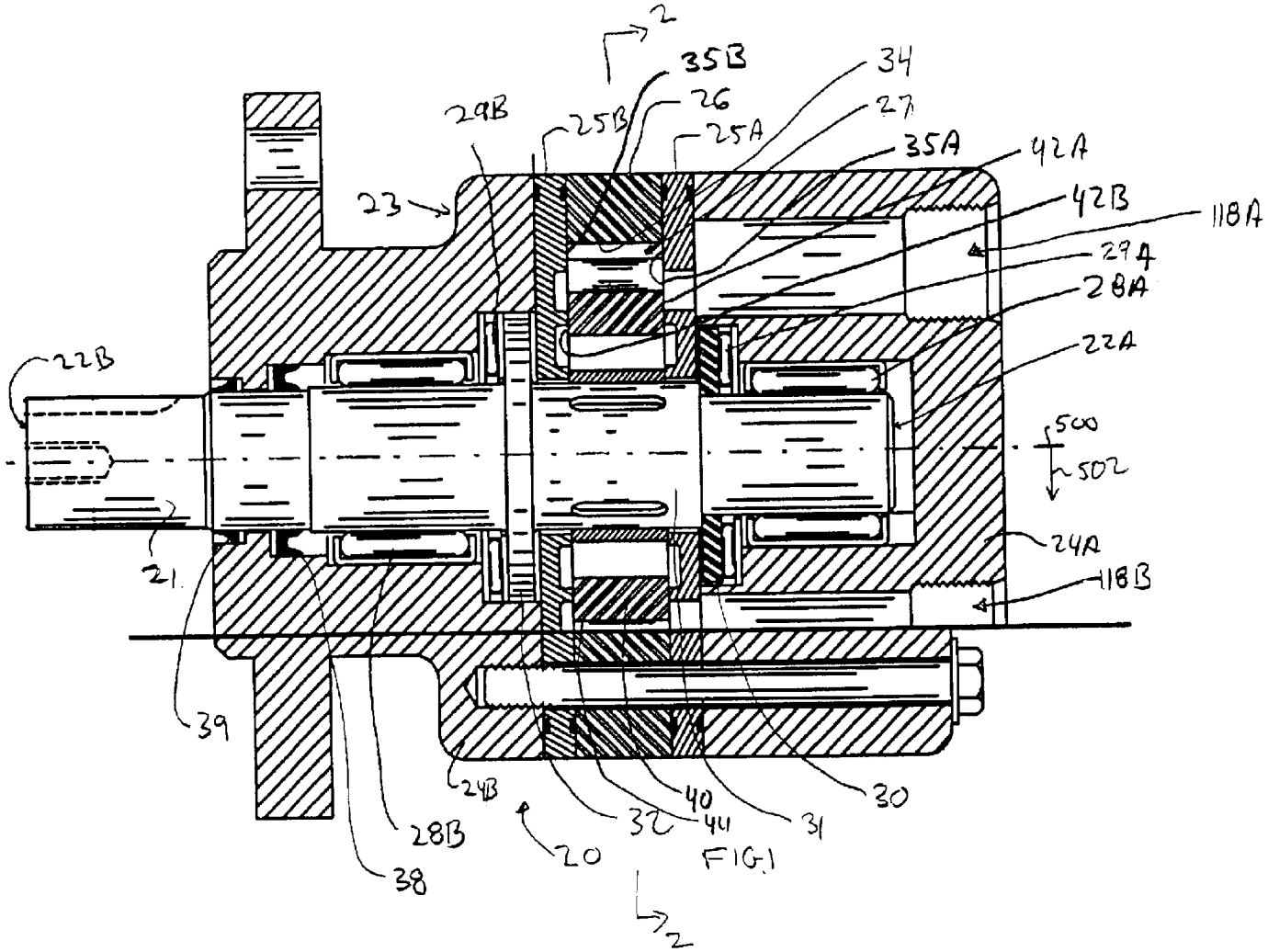
FIG. 1 is a longitudinal sectional view of a fluid motor.

FIG. 1 shows a fluid motor 20. The motor includes a shaft 21 extending from a first (rear) end 22A to a second (front) end 22B and having a central longitudinal axis 500. A front end portion of the shaft may be coupled to a load (not shown) to apply a drive torque to the load. The shaft is held by a housing assembly 23 for rotation about the axis 500. The housing assembly extends from a rear cover 24A to a front cover 24B and has several intermediate body members, namely rear and front plates 25A and 25B and a cam ring 26 therebetween. As described below, the rear plate 25A serves as a valve plate and the front plate 25B serves as a wearplate The housing assembly defines one or more main spaces, compartments or chambers 27.

In the exemplary embodiment, the shaft is supported for rotation about the axis 500 by rear and front radial bearings 28A and 28B and rear and front thrust bearings 29A and 29B. In the exemplary embodiment, the rear radial bearing 28A is accommodated within a bearing compartment of the rear cover and engages a rear end portion of the shaft while the front radial bearing 28B is accommodated within a bearing compartment of the front cover 24A and engages an intermediate portion of the shaft. Between these portions, the rear radial bearing 29A is accommodated within a compartment in the rear cover and between a shoulder of that compartment and a thrust washer 30 which in turn bears against a central portion 31 of the shaft. Just ahead of the central portion 31, the front thrust bearing 29 is accommodated within a bearing compartment of the front cover and between a shoulder of that compartment and a shaft flange 32. Radially (e.g., in a direction 502 relative to the axis 500) the chamber 27 is bounded by a wall surface 34 of the cam ring 26 circumscribing the axis 500. Axially, the chamber 27 is substantially bounded by interior surface portions 35A and 35B of the plates 25A and 25B. Various seals (e.g., a shaft seal 38 and a dust seal 39) may be produced.

A rotor 40 is located within the chamber 27. The exemplary rotor has rear and front end faces 42A and 42B contacting or in close facing proximity to plate surfaces 35A and 35B. A lateral perimeter surface 44 joins the faces 42A and 42B. In the exemplary rotor of FIG. 2, the footprint and transverse section of the rotor is elongate, extending from a first end 46A to a second end 46B, and having first and second flank areas 48A and 48B. The exemplary rotor has longitudinal and transverse planes of symmetry defined by respective axes 504 and 506 and extending parallel to the shaft axis 500. The end portions of the rotors are generally semicircular. The rotor lateral perimeter surface 44 is in facing proximity to the cam ring wall surface 34, the relative orientation and position being determined by the cycling of the motor as is discussed below. At any given point in the cycle, the rotor will divide the chamber 27 into two portions 56A and 56B, respectively adjacent the first and second flank areas 48A and 48B. The position and volume of such chamber portions may respectively vary during the cycle in accordance with the functioning of the motor.

The rotor 40 has an internal compartment 60 which, in the exemplary embodiment, is elongate in the direction 504, extending between first and second end surfaces 62A and 62B. The compartment has lateral surfaces 64A and 64B connecting the end surfaces and cooperating with such end surfaces to circumscribe the axis 500. The exemplary compartment is longitudinally open at the rotor faces 42A and 42B. A piston 70 is located within the compartment and has first and second end surfaces 72A and 72B in facing or contacting (depending upon the cyclic state) proximity to the compartment end surfaces 62A and 62B, respectively. The piston has lateral surfaces 74A and 74B in respective sealing engagement with the compartment lateral surfaces 64A and 64B so as to divide the compartment into first and second end volumes or spaces 80A and 80B, respectively. First and second axial end surfaces of the piston may be in close facing proximity to the plate interior surfaces 35A and 35B. The piston 70 is secured relative to the shaft central portion 31 (e.g., by mounting or by unitary formation) to prevent relative rotation about the axis 500 so that the piston and shaft rotate about such axis as a unit.

Exemplary shaft material is hardened forged steel. Exemplary cover material is high density cast iron. Exemplary cam ring and plate material is hardened steel. Exemplary piston material is hardened forged steel. Exemplary material for the body of the rotor is hardened forged steel. Other materials are possible. Exemplary fluid is petroleum-based hydraulic fluid. Other liquids and gases may be used.

Figure 3:
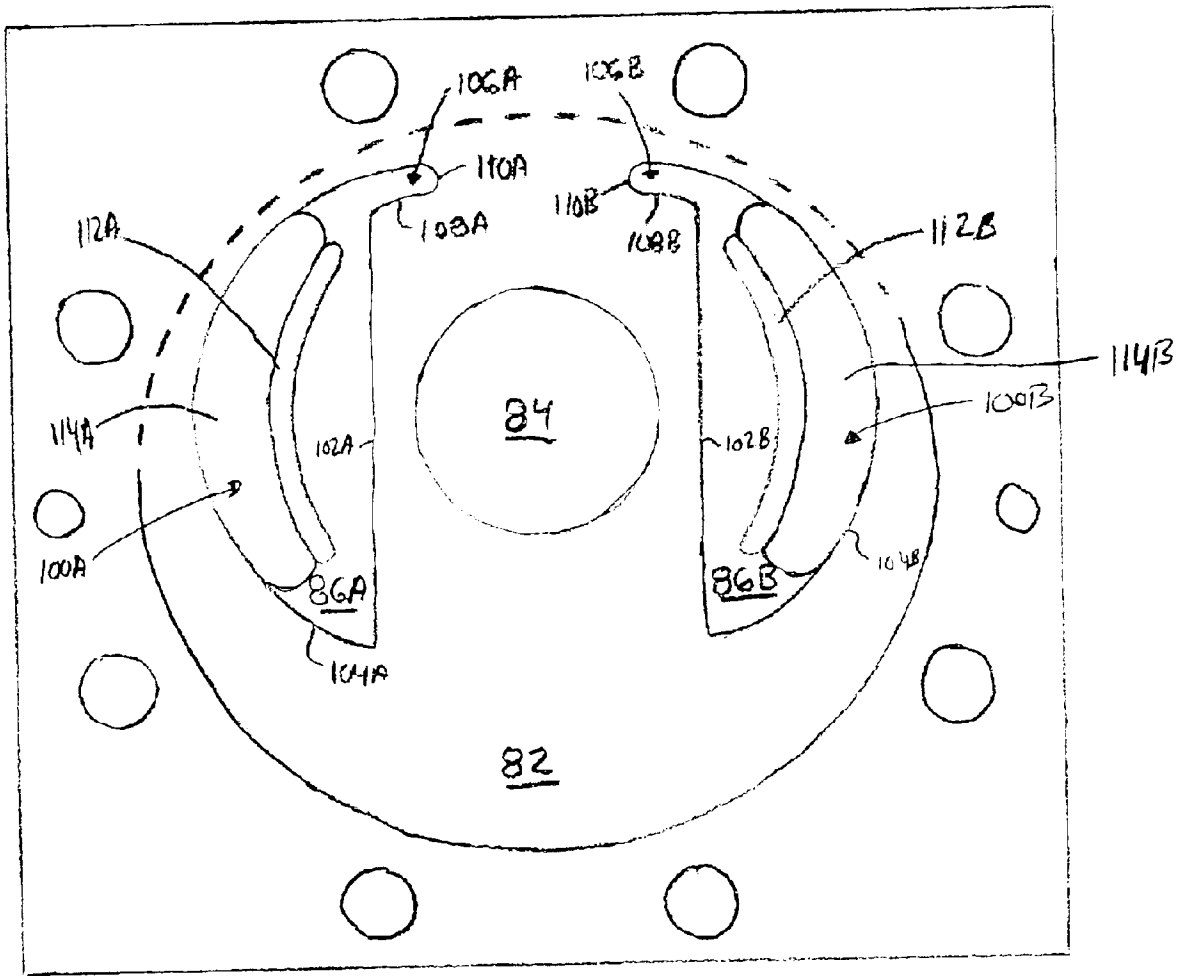
FIG. 3 is a plan view of a rear plate of the motor of FIG. 1.

The rear plate (FIG. 3) has a planar inboard surface 82 which provides the interior surface 35 and a central aperture 84 for passing the shaft. The rear plate includes a pair of ports 86A and 86B in the interior surface. The ports may be formed as through apertures between interior and outboard surfaces and/or may be formed as depressed areas below a planar portion of the interior surface and communicating with the outside world via channels (not shown). Each exemplary port is formed having a first (main) portion 100A and 100B, respectively formed extending outward from a vertical chordline 102A and 102B to an arcuate perimeter 104A and 104B. A second portion 106A and 106B of each port is formed as an arcuate finger-like segment extending inward from a top extreme of the chordline 102A and 102B bounded at the top by the continuation of the curve 104A and 104B and bounded below by a generally parallel curve 108A and 108B and bounded at an end by an end surface 110A and 110B. Within each first portion 100A and 100B there is a generally central arcuate island 112A and 112B, the surface of which is a coplanar portion of the surface 82 and the function of which is described in further detail below. In the exemplary embodiment, the islands 112A and 112B are supported and joined to the rest of the rear plate by webs 114A and 114B, the interior surface of which is recessed relative to that of the remainder of the plate to permit fluid communication from the rest of the associated port to the front interior side of such web.

In the exemplary embodiment, the front plate has an interior (rear) side with recessed areas similarly sized and shaped and aligned with the ports of the rear plate (including the presence of islands within the recessed areas). The ports of the rear plate are in communication with respective ports 118A and 118B in the rear cover permitting fluid communication with an exterior destination and source. The presence of recessed areas in the inboard side of the front plate complementary to both the recessed and open areas of the rear plate permits fluid communication through the chamber 27 to apply similar pressures to front and rear faces of the rotor to create axial balance, reducing wear and friction. Alternatively, for each plate, one port may be coupled to the high pressure source and the other port may be coupled to the relatively low pressure destination. The respective source (inlet) ports of the two plates would be opposite each other about a transverse centerplane of the motor as are the respective destination (discharge/outlet) ports. For example and purposes of illustration, the port(s) on the left side of the apparatus are designated as outlet port(s) and port(s) on the right side of the motor are designated the inlet port(s).

Figure 2:
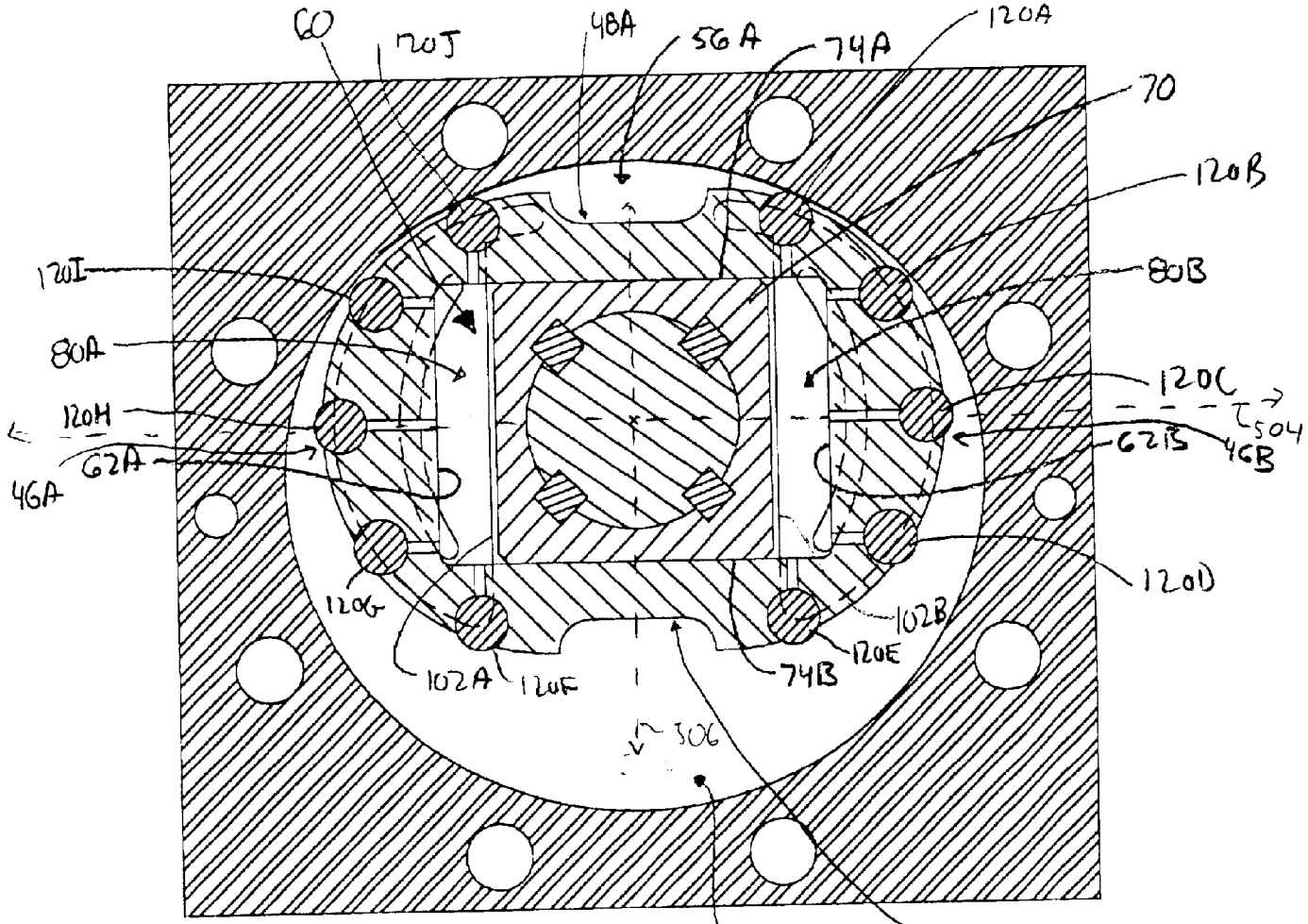
FIG. 2 is a transverse sectional view of the motor of FIG. 1 in a first condition.
Figure 4:
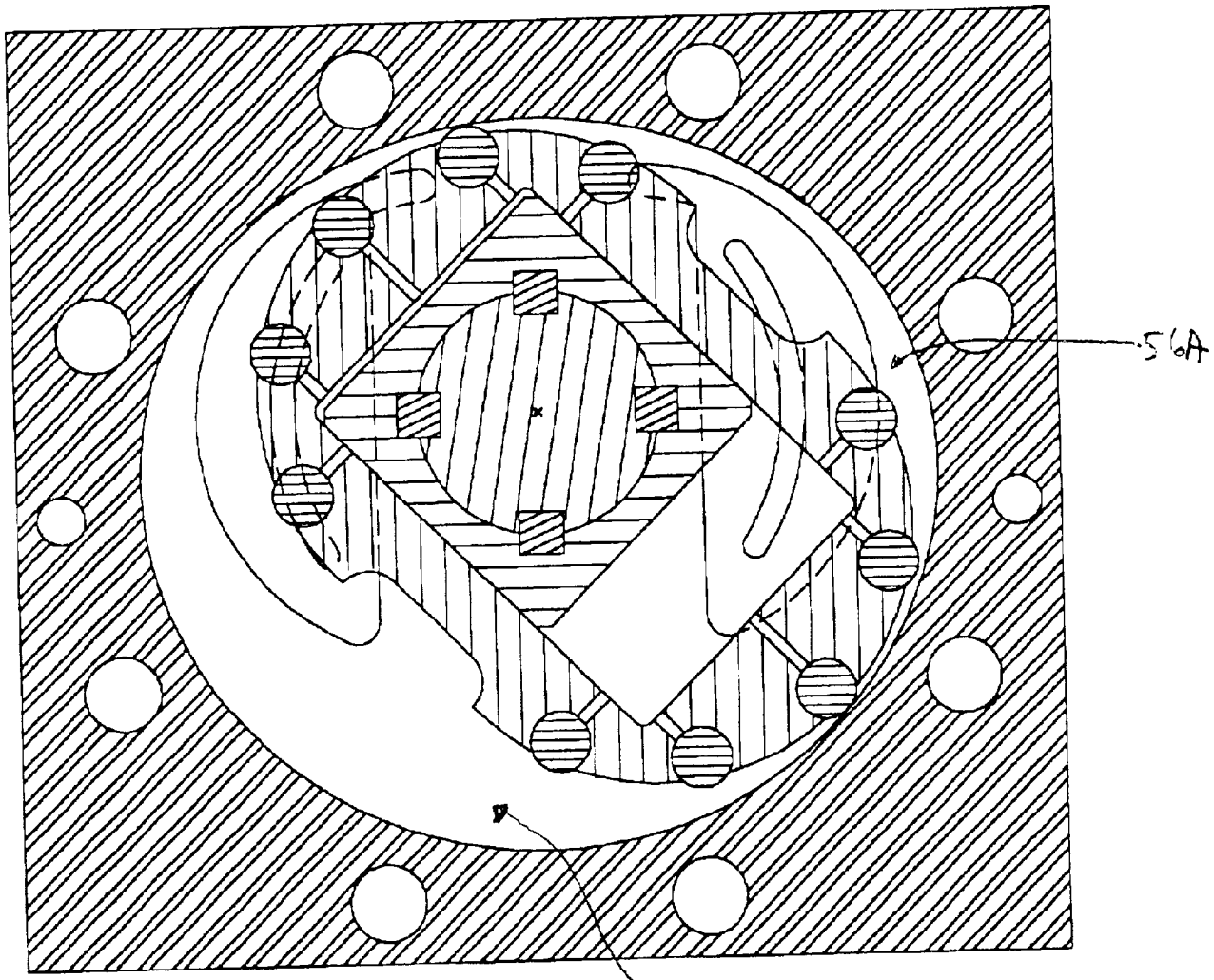
FIG. 4 is a transverse sectional view of the motor of FIG. 1 in a second condition.
Figure 5:
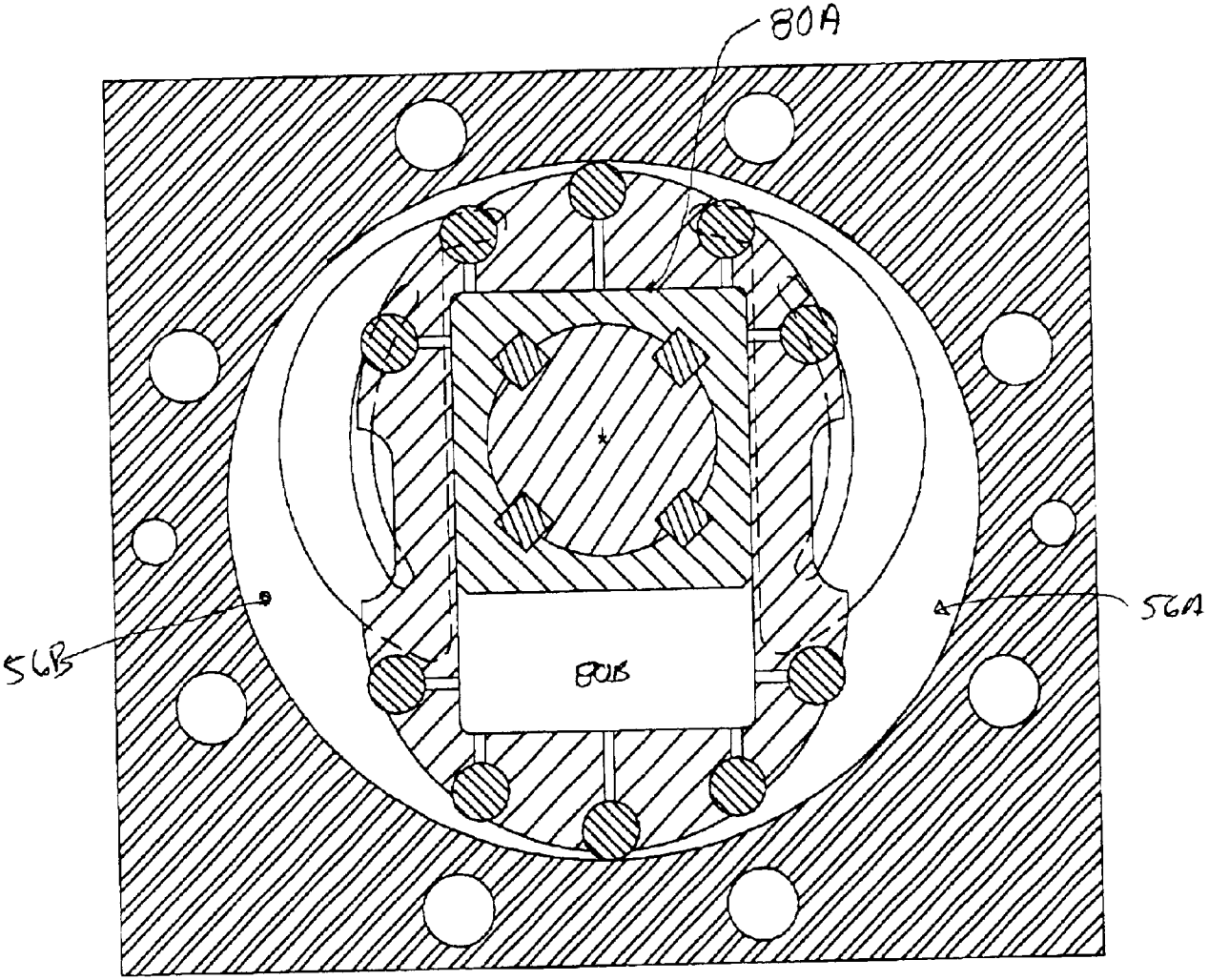
FIG. 5 is a transverse sectional view of the motor of FIG. 1 in a third condition.
Figure 6:
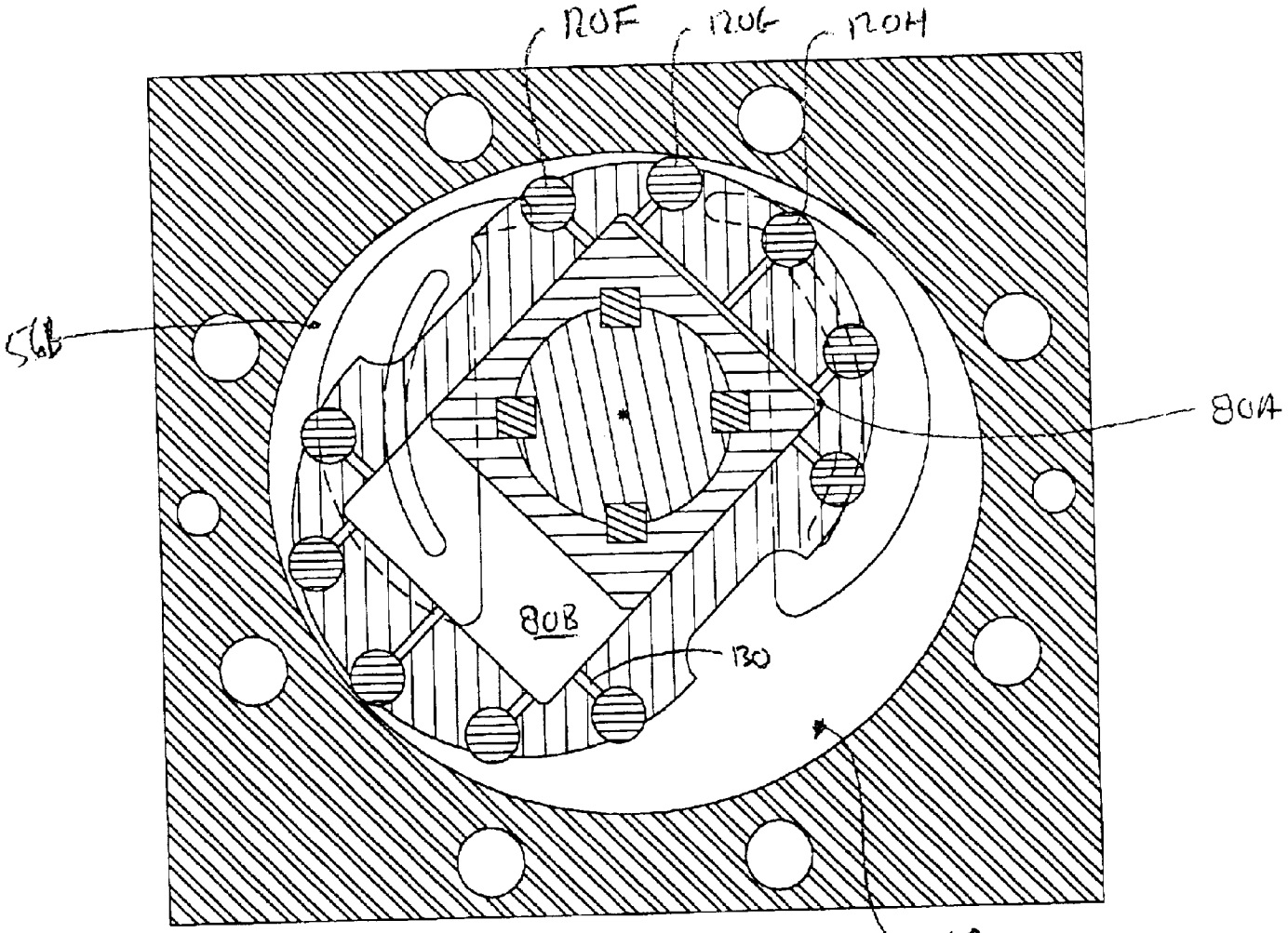
FIG. 6 is a transverse sectional view of the motor of FIG. 1 in a fourth condition.

In a first condition of FIG. 2, the rotor is in a neutral orientation extending left-to-right. In this orientation, the end portions of the rotor block outboard portions of the inlet and outlet ports and specifically prevent communication of such ports with the chamber portions 56A and 56B. A central inboard portion of the outlet port is open to the space 80A and a central portion of the inlet port is open to the space 80B. The resulting pressure differential across the piston biases the rotor rightward (as viewed in FIG. 2) so as to increase the size of the of the space 80B and decrease the size of the space 80A. This movement produces a camming interaction between the rotor 40 and the chamber wall surface. In this embodiment, the initial camming interaction is between the wall surface 34 and a roller 120A carried by the rotor body. This camming interaction will tend to rotate the rotor clockwise as viewed in FIG. 2. The combined rotation and translation of the rotor will then: (1) cause the rotor to expose the chamber portion 56A to the inlet port (initially by exposing a tip portion of the port finger 106B and subsequently by exposing some of the main port portion 100B); and (2) cause the rotor to expose the chamber portion 56A to the outlet port. In the exemplary embodiment these two events occur simultaneously. FIG. 4 shows the rotor having so rotated. During this rotation, the chamber portion 56A is expanding in volume while the chamber portion 56B is contracting. Because these chamber portions are no longer centered relative to the axis 500, they exert a net torque on the rotor (and on the shaft via the piston) further rotating the shaft clockwise as viewed in the figures). During this stage, there is inlet flow both to the chamber portion 56A and to the space 80B and outlet flow from the chamber portion 56B and space 80A. The rotor further rotates in the clockwise direction (and experiences associated translation), reaching the vertical orientation of FIG. 5. In this orientation, in the exemplary embodiment, the space 80B has reached its maximum volume and the space 80A has reached its minimum volume (shown essentially as a nullity). In this orientation, both these spaces are temporarily no longer aligned with either port and therefore receive or expel no fluid. The chamber portion 56A, however, remains exposed to the inlet port and the chamber portion 56B remains exposed to the outlet port. The continued off-center position relative to the axis 500 maintains the torque on the rotor tending to rotate the rotor clockwise as viewed in the figures. Further rotation brings the space 80A into communication with the inlet port and brings the space 80B in communication with the outlet port. The pressure difference across the piston now can exert a force on the rotor causing a camming interaction between the rotor's first end portion 46A (namely via rollers 120H, 120G, and 120F sequentially) and the wall surface 32. This camming interaction applies further torque to the shaft in similar manner to that described above. As rotation progresses further, the rotor will return to an orientation like that of FIG. 2 but rotated 180°. This mini cycle (associated with only 180° of rotation of the shaft) can then repeat with the first end portion behaving as the second end portion has done and vice versa to complete the full cycle 360° rotation. The direction of rotation may be reversed by switching the source and destination.

The exemplary rotor includes optional cylindrical rollers 120A–120J as discussed above. In the exemplary embodiment, these rollers are cylindrical in nature, located within complementary pockets in the rotor body. In the exemplary embodiment, the islands 112A and 112B are positioned so that end portions of the rollers can pass adjacent to them so that the islands may help maintain the longitudinal alignment of the rotors. Advantageously the rollers are axially contained at all times by the islands or other areas of the plates. Additionally, lubrication of the rollers may be provided in part by channels 130 extending from the adjacent spaces 80A or 80B.

Exemplary operating parameters may be in line with other types of low speed, high torque (LSHT) fluid motors (typically operating below 1000 rpm to avoid use of a reduction gearbox).

One or more embodiments of the present invention have been described. Nevertheless, it will be understood that various modifications may be made without departing from the spirit and scope of the invention. Identifications of direction are relative and for purposes of illustration. The motor may assume a variety of orientations. The shaft may extend through both covers to provide two outputs (e.g., to drive accessories in addition to a primary output). The shaft may be hollow to permit passage of coolant or hardware through the shaft to the driven apparatus. Multi-rotor configurations are possible to provide a broader performance envelope. In such multi-rotor applications the rotors could have different dimensions (e.g., widths) and could be operated separately or together. Additionally, the ports may be reshaped, repositioned, or subdivided and the rotor may be reshaped. Such changes to the ports and rotor could well be complementary. The motor configuration could be applied to a pump or engine. Additional manufacturing- or engineering-related details or features may be included as are known in the art or subsequently developed. Accordingly, other embodiments are within the scope of the following claims.

What is claimed is:

1. An apparatus for extracting work from a fluid passing between a pressure source and a destination comprising:

a housing having first and second side walls and a perimeter wall extending therebetween to substantially surround an internal space, the housing having at least one inlet port for establishing communication between the internal space and the source and at least one outlet port for establishing communication between the internal space and the destination;

a rotor mounted within the internal space and having a perimeter surface, first and second side surfaces, and a compartment, the perimeter surface including first and second flanks and first and second apexes;

a piston mounted within the compartment for relative reciprocal motion within the compartment and separating first and second portions of the compartment; and an output shaft mounted for rotation relative to the housing about a shaft axis and coupled to the piston to be driven by rotation of the piston about the shaft axis through a cycle including:

a first orientation in which the first compartment portion communicates with the source and the second compartment communicates with the destination so that a pressure difference between the first and second compartment portions biases the rotor in a first direction relative to the piston and produces a first camming interaction between the rotor and the perimeter wall, said first camming interaction applying torque of a first sense to the shaft via the rotor and piston to rotate the shaft;

a second orientation in which a first portion of the internal space adjacent the first flank communicates with the source and a second portion of the internal space adjacent the second flank communicates with the destination and wherein the rotor and shaft are non-concentric so that a pressure difference between the first and second portions of the internal space applies torque of said first sense to the shaft via the rotor and piston to rotate the shaft;

a third orientation in which the first compartment portion communicates with the destination and the second compartment communicates with the source so that a pressure difference between the first and second compartment portions biases the rotor in a second direction relative to the piston and produces a second camming interaction between the rotor and the perimeter wall, said first camming interaction applying torque of said first sense to the shaft via the rotor and piston to rotate the shaft; and a fourth orientation in which a first portion of the internal space adjacent the first flank communicates with the destination and a second portion of the internal space adjacent the second flank communicates with the source and wherein the rotor and shaft are non-concentric so that a pressure difference between the first and second portions of the internal space applies torque of said first sense to the shaft via the rotor and piston to rotate the shaft.

2. The apparatus of claim 1 wherein:

the rotor has two orthogonal planes of symmetry parallel to the shaft axis; and the rotor first and second flanks each have a recessed area.

3. The apparatus of claim 1 wherein:

the rotor comprises a plurality of perimeter bearings.

4. The apparatus of claim 3 wherein:

the perimeter bearings are rollers, each roller positioned in a bearing compartment communicating with the rotor compartment via a lubrication conduit in the rotor.

5. The apparatus of claim 1 wherein said fluid is a liquid.

6. An apparatus for extracting work from a fluid passing between a pressure source and a destination comprising:

a housing having an internal space;

a rotor mounted within the housing internal space;

a piston mounted within the rotor; and an output member mounted for rotation relative to the housing about an axis; and means for driving the output member by applying a pressure difference from said fluid:

across said rotor within said internal space; and across the piston so as to bias the rotor against the housing and produce a camming action to rotate the rotor.

7. The apparatus of claim 6 in combination with a flow of said fluid through the apparatus, said fluid being a liquid.

8. An apparatus for passing fluid between a source and a destination comprising:

a housing having first and second side walls and a perimeter wall extending therebetween to substantially surround an internal space, the housing having at least one inlet port for establishing communication between the internal space and the source and at least one outlet port for establishing communication between the internal space and the destination;

a rotor mounted within the housing internal space and having a perimeter surface and first and second side surfaces and a compartment, the rotor perimeter including first and second flanks and first and second apexes;

a piston mounted within the rotor compartment for relative reciprocal motion within the compartment and separating first and second portions of the compartment; and an output shaft mounted for rotation relative to the housing about a shaft axis and coupled to the piston to be driven by rotation of the piston about the shaft axis through a cycle including:

a first orientation in which the first compartment portion communicates with the source and the second compartment communicates with the destination so that a pressure difference between the first and second compartment portions biases the rotor in a first direction relative to the piston and produces a first camming interaction between the rotor and the perimeter wall, said first camming interaction applying torque of a first sense to the shaft via the rotor and piston to rotate the shaft;

a second orientation in which a first portion of the housing internal space adjacent the first flank communicates with the source and a second portion of the housing internal space adjacent the second flank communicates with the destination and wherein the rotor and shaft are non-concentric so that a pressure difference between the first and second portions of the housing internal space applies torque of said first sense to the shaft via the rotor and piston to rotate the shaft;

a third orientation in which the first compartment portion communicates with the destination and the second compartment communicates with the source so that a pressure difference between the first and second compartment portions biases the rotor in a second direction relative to the piston and produces a second camming interaction between the rotor and the perimeter wall, said second camming interaction applying torque of said first sense to the shaft via the rotor and piston to rotate the shaft; and a fourth orientation in which a first portion of the housing internal space adjacent the first flank communicates with the destination and a second portion of the housing internal space adjacent the second flank communicates with the source and wherein the rotor and shaft are acentric so that a pressure difference between the first and second portion of the housing internal spaces applies a torque of said first sense to the shaft via the rotor and piston to rotate the shaft.

9. The apparatus of claim 8 wherein said fluid is a liquid.

* * * * *